United States Patent [19]

Bearden et al.

[11] 4,219,917

[45] Sep. 2, 1980

[54] PUMP MODIFICATION FOR MATCHING PERFORMANCE

[75] Inventors: John L. Bearden, Schaumberg; Sankaraiyer Gopalakrishnan, Roselle; John J. Tuzson, Evanston, all of Ill.

[73] Assignee: Borg-Warner Corporation, Chicago, Ill.

[21] Appl. No.: 698,231

[22] Filed: Jun. 21, 1976

[51] Int. Cl.[3] ..... B23P 13/00; B23P 15/02

[52] U.S. Cl. ..... 29/156.4 R; 29/156.8 R; 415/DIG. 3

[58] Field of Search ..... 29/156.4 R, 156.8 R; 415/DIG. 3, 501, 199.2, 199.3

[56] References Cited

U.S. PATENT DOCUMENTS

| | | | |
|---|---|---|---|
| 931,636 | 8/1909 | Neumann | 415/DIG. 3 |
| 1,127,997 | 2/1915 | Jennings | 415/DIG. 3 |
| 1,670,065 | 5/1928 | Eisenwinter | 415/DIG. 3 |
| 2,273,420 | 2/1942 | Schott | 415/199.2 |
| 2,474,077 | 6/1949 | Trumpler | 415/DIG. 3 |
| 2,854,926 | 10/1958 | Haight et al. | 415/199.2 |
| 3,543,368 | 12/1970 | Marlow | 415/DIG. 3 |
| 3,664,001 | 5/1972 | Pilarczyk | 29/156.4 R |

FOREIGN PATENT DOCUMENTS

| | | | |
|---|---|---|---|
| 333443 | 8/1930 | United Kingdom | 415/DIG. 3 |
| 613892 | 12/1948 | United Kingdom | 415/DIG. 3 |
| 785419 | 10/1957 | United Kingdom | 415/DIG. 3 |

*Primary Examiner*—Daniel C. Crane
*Attorney, Agent, or Firm*—Aubrey L. Burgess

[57] ABSTRACT

The operating characteristics and the nominal, best operating point of a multi-stage centrifugal pump are shifted to lower flow rates without loss of nominal head and without substantial loss of efficiency by machining or otherwise shortening the trailing edge of all or some of the stationary guide vanes of the diffusers between impeller stages. By so doing, a single pump size can be adapted to a range of flow requirements, as desired. Thus, it is possible to reduce the number of pump sizes manufactured, and yet supply the needs of customers.

1 Claim, 2 Drawing Figures

PUMP MODIFICATION FOR MATCHING PERFORMANCE

BACKGROUND OF THE INVENTION

Multi-stage centrifugal pumps may consist of 100 or more stages, each stage consisting of a rotating impeller and a stationary stator or diffuser. The stator or diffuser returns the flow from the outlet of an impeller to the inlet of the impeller of the next stage. The stationary stator or diffuser contains blades which are usually designed so that the fluid leaving the stator and entering the impeller of the next stage does not rotate. The alternate impellers and diffusers pump fluid from an inlet through the various stages of the pump to the outlet.

Manufacturers of multi-stage centrifugal pumps produce a number of models of pumps of progressively larger capacity and larger diameters in order to offer models for a large range of flow rates with good operating efficiencies. When it is necessary to custom match a pump to a particular specification, as required by a customer, one procedure is to machine and reduce the outer diameter of the pump impeller. This procedure not only reduces flow rates, but also reduces the pressure head produced by the pump and affects the pump efficiency.

THE INVENTION

It has been found that if the trailing edges of all or some of the stationary guide vanes of the stators or diffusers in a multi-stage centrifugal pump are shortened, or "machined back," the pump will operate at a lower flow rate without reducing the nominal head or substantially reducing the operating efficiency of the pump. The stage in which this procedure is followed behaves as if it had been designed for the lower flow rate.

Thus it is possible, by utilizing this invention, to custom match a pump to a customer's requirements. The number of pump sizes manufactured can be reduced because a next larger pump can be adapted for a lower flow rate by the modification described. The usual number of sizes of pumps manufactured could be reduced at least by one half by eliminating at least every second size. This procedure leads to lower manufacturing costs and less inventory requirements.

THE DRAWINGS

FIG. 1 is a sectional partial view of a multi-stage centrifugal pump indicating the application of this invention thereto; and FIG. 2 are pump performance curves for a multi-stage pump before and after modification according to this invention.

DETAILED DESCRIPTION

Figure 1:
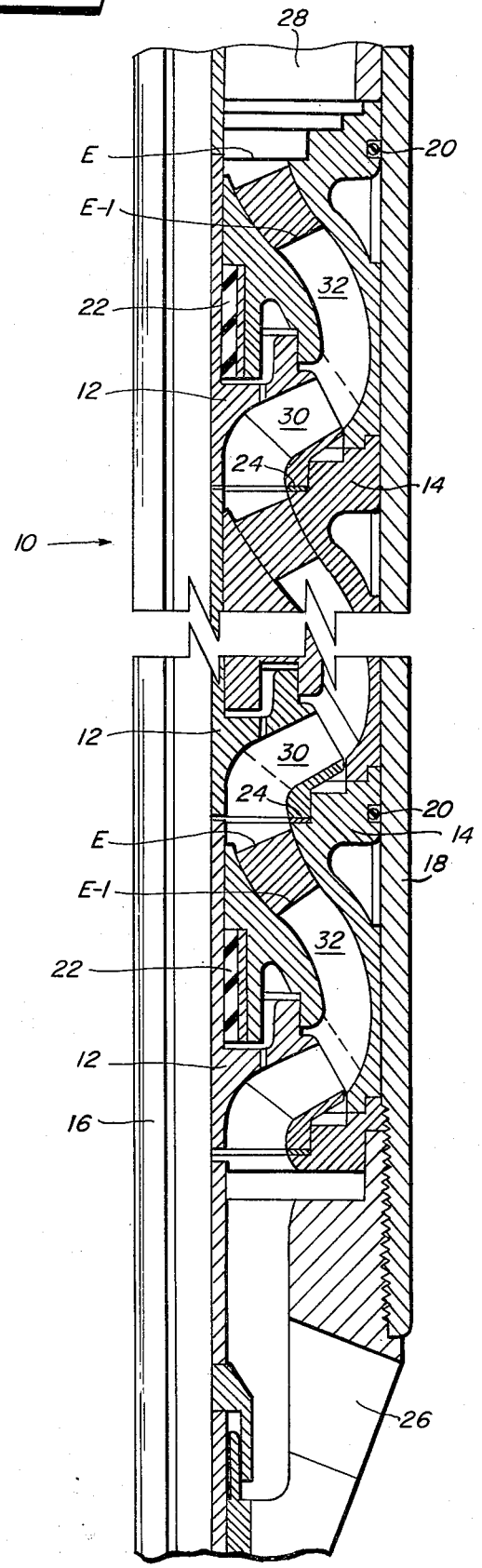

Referring to the drawings, there is illustrated a sectional partial view of a multi-stage centrifugal pump 10, each stage of which comprises an impeller 12 and a diffuser 14, which alternate with each other. Each impeller 12 is drivingly connected, as by a key, to the longitudinal shaft 16, so as to rotate therewith. The shaft 16 is connected to a motor, not shown. Each diffuser 14 is stationary and is secured to an elongated cylindrical pump housing 18. O-rings 20 are interfaced between the housing 18 and the diffusers 14 and also suitable bearings 22 and thrust bearings 24 provided, as necessary. The housing 18 is provided with an inlet 26 and an outlet 28 for the flow to and from the pump. Each impeller 12 and each diffuser 14 is constructed with blades 30 and 32, respectively.

The structure as described is conventional in multi-stage centrifugal pumps. In operation, with the impellers 12 rotating, fluid enters the inlet 26 to the first impeller which pumps fluid to the first diffuser. The diffuser directs the fluid to the second stage and the diffuser blades 32 deliver the fluid to the next succeeding stage with little or no pre-swirl. The capacity of the conventional pump depends on the rpm of the impellers, the number of stages and the size i.e., the diameter of the pump.

It has been determined that by modifying i.e., reducing the length of the trailing edges E of the diffuser blades 32, the capacity of the pump can be modified. If the length of the blades is reduced for example, by removing or "machining back" the trailing edge E, so that a new trailing edge E-1 is presented, the capacity of the pump is reduced without substantially reducing the efficiency of the pump. Reducing the length of the blades 32 causes or permits some swirling of the fluid to the next stage of the pump. Using this procedure permits one to tailor a pump of a given size to a particular requirement; it also reduces the number of pump sizes which need to be stocked.

Figure 2:
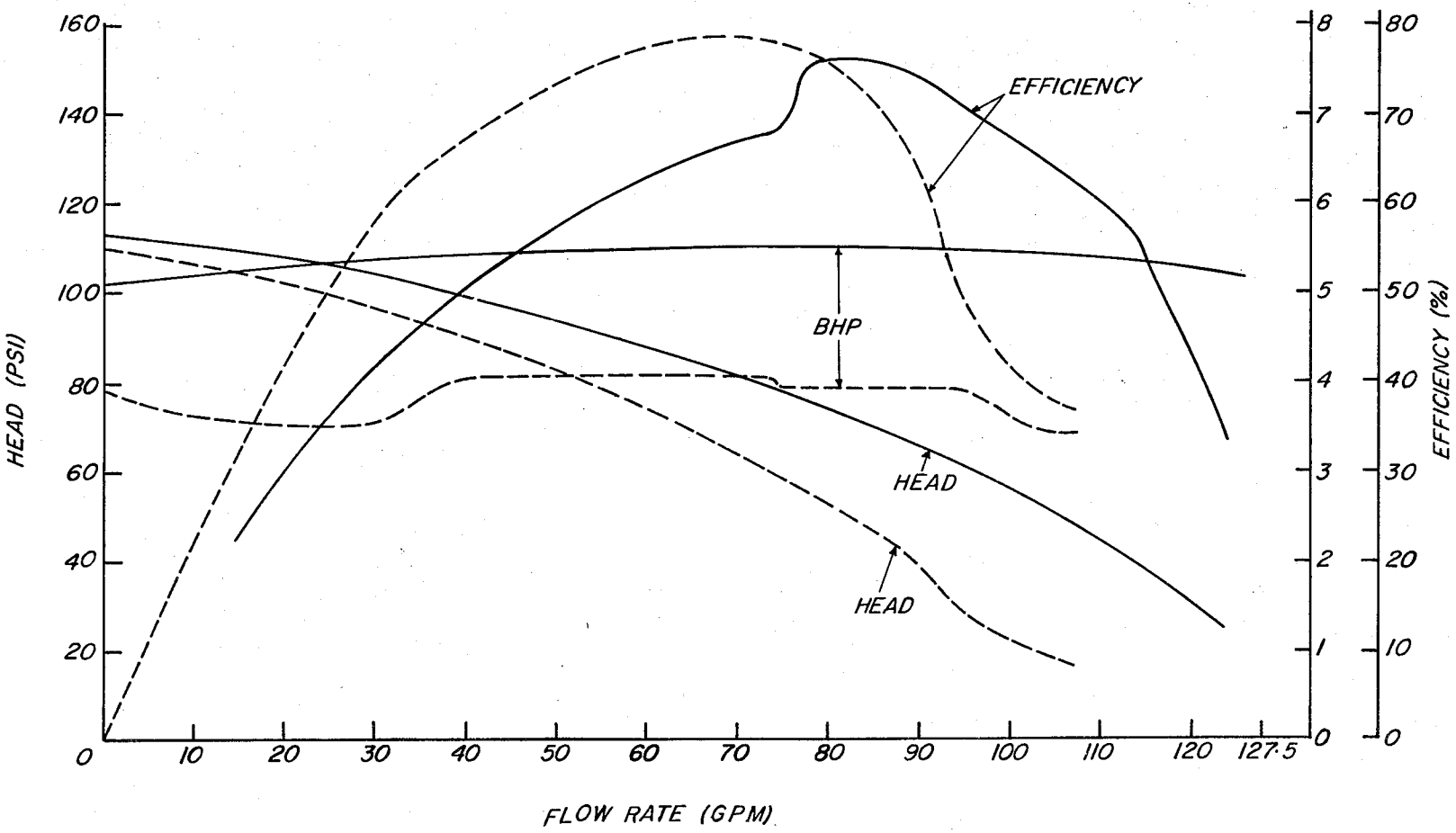

FIG. 2 are pump performance curves plotted against flow rate in gallons per minute (gpm). Curves for the head, power (bhp) and efficiency are plotted for an experimental multi-stage pump having six (6) stages with the liquid being 100% diesel fuel and a system pressure of zero psig. The solid curves are for the normal diffuser; each curve is identified; the broken line curves are for a modified, i.e., "machined back" trailing edge blade diffuser. The reduction in blade length was about 23% of its total length.

The most drastic change in the curves is in the pump capacity, as indicated by the power (bhp) curve.

The best pump performance usually occurs when the direction of flow entering the impeller is exactly aligned with the direction of the blades. When the flow rate of the pump is reduced by a certain percentage X, perfect alignment of the flow and blades is not preserved. This results in losses unless the flow entering the pump is given a certain rotational velocity in the direction of shaft rotation. The added prerotation velocity has to be the same percentage of the pump rotational velocity at the impeller eye as the above mentioned percentage of flow reduction. It was found in the experimental work described that, in a multi-stage pump, this is best accomplished by "machining back" or reducing the length of the trailing edges the blades of the diffuser of the preceeding stage. The amount of machining will depend on the diffuser blade shape or blade angle distribution. The direction of the diffuser blade will form an angle "$\theta$" with the radial direction which will vary along the blade. The axial width of the diffuser "b" may also vary. The location where the blade has to be cut off can be identified by finding the values of $\theta$ and b which satisfy the equation:

$$\checkmark = Q \tan \theta / 2\pi r b$$

where $\checkmark$ = required tangential velocity at the impeller eye
Q = required flow rate
$\theta$ = diffuser blade angle with radial direction
b = axial width of diffuser r=average radius of impeller eye In applying the equation above, assume that the location of best efficiency is to be reduced from 80 gpm; to 60 gpm; i.e., a 25% reduction. The desired flow rate is then:

$$Q=60 \text{ gpm}=230 \text{ cubic inches/sec.}$$

The required prerotation velocity would be 25% of the rotational velocity at the impeller eye. The average diameter of the experimental impeller is:

$$2r=1.75 \text{ in.}$$

and the shaft turns at:

$$N=3600 \text{ rpm}$$

The rotational velocity is:

$$2\pi Nr/60=(2\pi\times3600\times0.875)/60=330 \text{ in./sec.}$$

The prerotational velocity is:

$$V=0.25\times330 \text{ in./sec.}=82.5 \text{ in./sec.}$$

Substituting into the equation the values for Q and V and also b=⅜ inch and r=0.875 inch, we have:

$$V=(Q \tan\theta)/2\pi rb=(230\times\tan\theta)/2\pi\times0.875\times\tfrac{3}{8}=112 \tan\theta=82.5$$

then $$\tan\theta=(82.5)/112=0.735=\tan 36°$$

Thus, the blades are cut back to the location where $\theta=36°$, in order to obtain peak efficiency at 60 gpm.

We claim:

1. A method for changing the operating flow characteristics of a multi-stage centrifugal pump to a lower operating flow characteristic having substantially the same operating efficiency, each diffuser having guide vanes with a leading edge and a trailing edge, said tracking edge being adjacent to the next impeller in the direction of fluid flow, said guide vanes directing the flow of fluid to the next adjacent impeller, the steps comprising:

constructing the guide vanes of each diffuser to a given length to provide a first operating characteristic with a first flow characteristic and, thereafter, reducing the length of the trailing edge only of at least one of the guide vanes to change the operating characteristics to a lower flow characteristic, the location of the reduction being identified by $\theta$ in the equation;

$$l=Q \tan\theta/2\pi rb$$

where $l$ =required tangential velocity at the impeller eye

Q=desired flow rate $\theta$=diffuser blade angle with the radial direction of the blade b=axial width of diffuser $\pi$=average radius of impeller eye.

* * * * *

UNITED STATES PATENT AND TRADEMARK OFFICE

CERTIFICATE OF CORRECTION

PATENT NO. : 4,219,917

DATED : September 2, 1980

INVENTOR(S) : John L. Bearden, et al

It is certified that error appears in the above—identified patent and that said Letters Patent is hereby corrected as shown below:

Column 4, line 11, cancel "track-" (at the end of the line) and insert -- trail- --.

Signed and Sealed this

*Eighteenth* Day of *November 1980*

[SEAL]

*Attest:*

SIDNEY A. DIAMOND

*Attesting Officer*

*Commissioner of Patents and Trademarks*